US007531130B2

(12) United States Patent
Ha et al.

(10) Patent No.: US 7,531,130 B2
(45) Date of Patent: May 12, 2009

(54) ANTI-GALLING ALLOY WITH FINELY DISPERSED PRECIPITATES

(75) Inventors: Heon Phil Ha, Guri-si (KR); Jae-Dong Shim, Seoul (KR); Kyung Tak Kim, Anyang-si (KR)

(73) Assignee: Korea Anti-Galling Metal Co., Ltd. (KR)

( * ) Notice: Subject to any disclaimer, the term of this patent is extended or adjusted under 35 U.S.C. 154(b) by 378 days.

(21) Appl. No.: 10/571,204

(22) PCT Filed: Oct. 2, 2003

(86) PCT No.: PCT/KR03/02041

§ 371 (c)(1),
(2), (4) Date: Mar. 7, 2006

(87) PCT Pub. No.: WO2005/024078

PCT Pub. Date: Mar. 17, 2005

(65) Prior Publication Data

US 2007/0113934 A1 May 24, 2007

(30) Foreign Application Priority Data

Sep. 9, 2003 (KR) ..... 10-2003-0063159

(51) Int. Cl.
*C22C 19/05* (2006.01)

(52) U.S. Cl. ..... 420/442; 148/410; 148/427

(58) Field of Classification Search ..... 420/441–442, 420/420; 148/555, 410, 427
See application file for complete search history.

(56) References Cited

OTHER PUBLICATIONS

No references have been cited by the Examiner at this time.*

* cited by examiner

*Primary Examiner*—John P. Sheehan
*Assistant Examiner*—Jessee R. Roe
(74) *Attorney, Agent, or Firm*—Baker & Hostetler, LLP

(57) ABSTRACT

The present invention relates to an anti-galling alloy with finely dispersed precipitates, more particularly to an anti-galling alloy comprising Ni, Cr, Sn, Bi, Mo, Fe, Si and Te, in which the matrix has a fine dendritic structure and the Bi-rich precipitates are finely dispersed between the dendritic structure, so that the anti-galling properties are significantly improved, while physicochemical properties such as corrosion resistance and hardness are not deteriorated. The anti-galling alloy of the present invention will greatly contribute to the improvement in life cycle and mechanical precision of a variety of wet machinery parts such as rotor, shaft, valve and mechanical sealing.

5 Claims, 5 Drawing Sheets

(A) Anti-galling alloy of present invention (B) Conventional anti-galling alloy (A) Anti-galling alloy of present invention (B) Conventional anti-galling alloy (B) Conventional anti-galling alloy (A) Anti-galling alloy of present invention

ANTI-GALLING ALLOY WITH FINELY DISPERSED PRECIPITATES

BACKGROUND OF THE INVENTION

1. Field of the Invention

The present invention relates to an anti-galling alloy with finely dispersed precipitates, more particularly to an anti-galling alloy comprising Ni, Cr, Sn, Bi, Mo, Fe, Si and Te, wherein the matrix has a fine dendritic structure and the Bi precipitates are finely dispersed on the dendritic structure, so that the anti-galling properties and physicochemical properties such as corrosion resistance and hardness can be significantly improved. The anti-galling alloy of the present invention will greatly contribute to the improvement in life cycle and mechanical precision of various wet machinery parts such as rotor, shaft, valve and mechanical sealing.

An anti-galling alloy refers to a metal that enables to maintain smooth surface when in contact with other metals, because it has a very low friction coefficient and prevents cracking due to contact stress. Therefore, anti-galling alloy has been widely used in industrial machineries having wet machinery parts which require frequent metal-metal contacts.

2. Description of the Related Art

Traditionally, lead-containing alloys have been used as anti-galling alloy. However, due to the harmfulness of lead to health, alloys containing no lead have been developed and used. Typical examples are Bi-containing Ni-matrix and Cu-matrix alloys [U.S. Pat. Nos. 3,145,099, 4,702,887, 5,242,657, 6,059,901 and 5,846,483].

Especially, the Ni—Cr—Sn—Bi based alloy has been known as suitable for use as rotor, shaft, valve and other mechanical sealing parts of driving machines, since it contains no lead and offers relatively good anti-galling properties. However, the Ni—Cr—Sn—Bi based alloy has insufficient abrasion resistance. Particularly, when it is in contact with stainless steel, its surface becomes scraped off roughly. The fast abrasion process results in reducing life cycle of a given material as well as impairing mechanical precision, so that it is not desirable to be used for wet parts or valves of various industrial machineries.

The key factors that determine the anti-galling properties are alloy composition and microstructure. Conventionally, researches have been focused on improvement of alloy compositions.

SUMMARY OF THE INVENTION

The present inventors have made numerous efforts to obtain an alloy with significantly improved anti-galling properties, corrosion resistance and hardness by altering the matrix structure. In order to achieve above mentioned superior anti-galling properties, matrix should have lubricating precipitates as small as possible and dispersing them uniformly on the matrix. The most practical way is altering alloy compositions, which gives significant improvement of anti-galling properties preserving fairly good physicochemical properties.

The present invention relates to a production method of an high performance anti-galling alloy with significantly improved anti-galling properties, corrosion resistance and hardness to be used for wet machinery parts such as rotor, shaft and mechanical sealing of various machineries.

DETAILED DESCRIPTION OF THE PREFERRED EMBODIMENTS

The present invention relates to an anti-galling alloy comprising 70 to 75wt % of Ni, 8 to 14 wt % of Cr, 3 to 6 wt % of Sn, 3 to 7 wt % of Bi, 1 to 4 wt % of Mo, less than 2.0 wt % of (Fe+Si) and 1 to 3 wt % of Te, which can be used as-prepared without heat treatment.

Hereinafter, the present invention is described in more detail.

Ni and Cr, main constituents of the anti-galling alloy of the present invention, affect thermal expansion and corrosion resistance. Bi-rich compound precipitates in the matrix and offers the anti-galling effect. Sn acts as a dispersant, aiding the Bi precipitates to uniformly disperse on the matrix. Mo affects strength of the anti-galling alloy. And, Te, the characteristic constituent of the present invention, acts as a grain refiner forming the fine dendritic structure of the matrix thereby finely dispersing Bi-rich precipitates between the dendritic spacing, which significantly improves the anti-galling properties.

The anti-galling alloy can have the properties aimed by the present invention only when the alloy composition satisfies the above-mentioned conditions.

Figure 1:
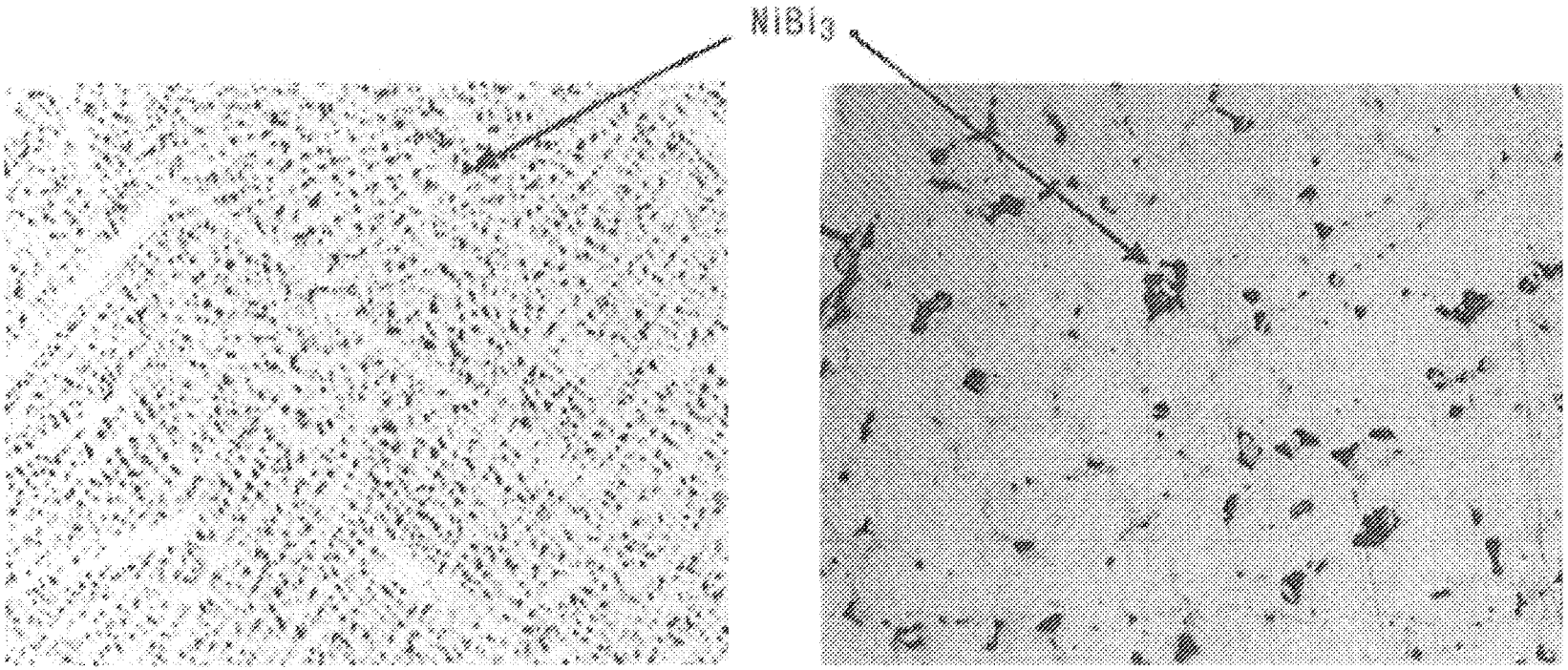
FIG. 1 shows optical microscopies (×50) of the Te-containing anti-galling alloy of the present invention (A) and the conventional anti-galling alloy (B), comparing the-microstructure and precipitate dispersion.

FIG. 1 shows optical microscopic photographs (×50) of the Te-containing anti-galling alloy of the present invention (A) and the conventional anti-galling alloy (B) not containing Te, comparing the microstructure and precipitate dispersion status. While the alloy of the present invention has a fine dendritic structure, the conventional alloy has a matrix composed of equiaxed grains having a coarse grain size. Also, while the Bi precipitates (dark spots) of the alloy of the present invention are distributed finely and uniformly with small spacing, the precipitates of the conventional alloy are distributed diffusely, having grown coarsely in hexagonal forms. When the content of the precipitates is equal, if the anti-galling precipitates are distributed finely, as in the present invention, they become uniformly coated on the alloy surface when in contact with other metals, so that the anti-galling effect is improved. Consequently, the friction coefficient decreases. Also, the surface-scraping galling problem is resolved and the seizing, or sticking of the anti-galling alloy to other metal, is prevented.

Figure 2:
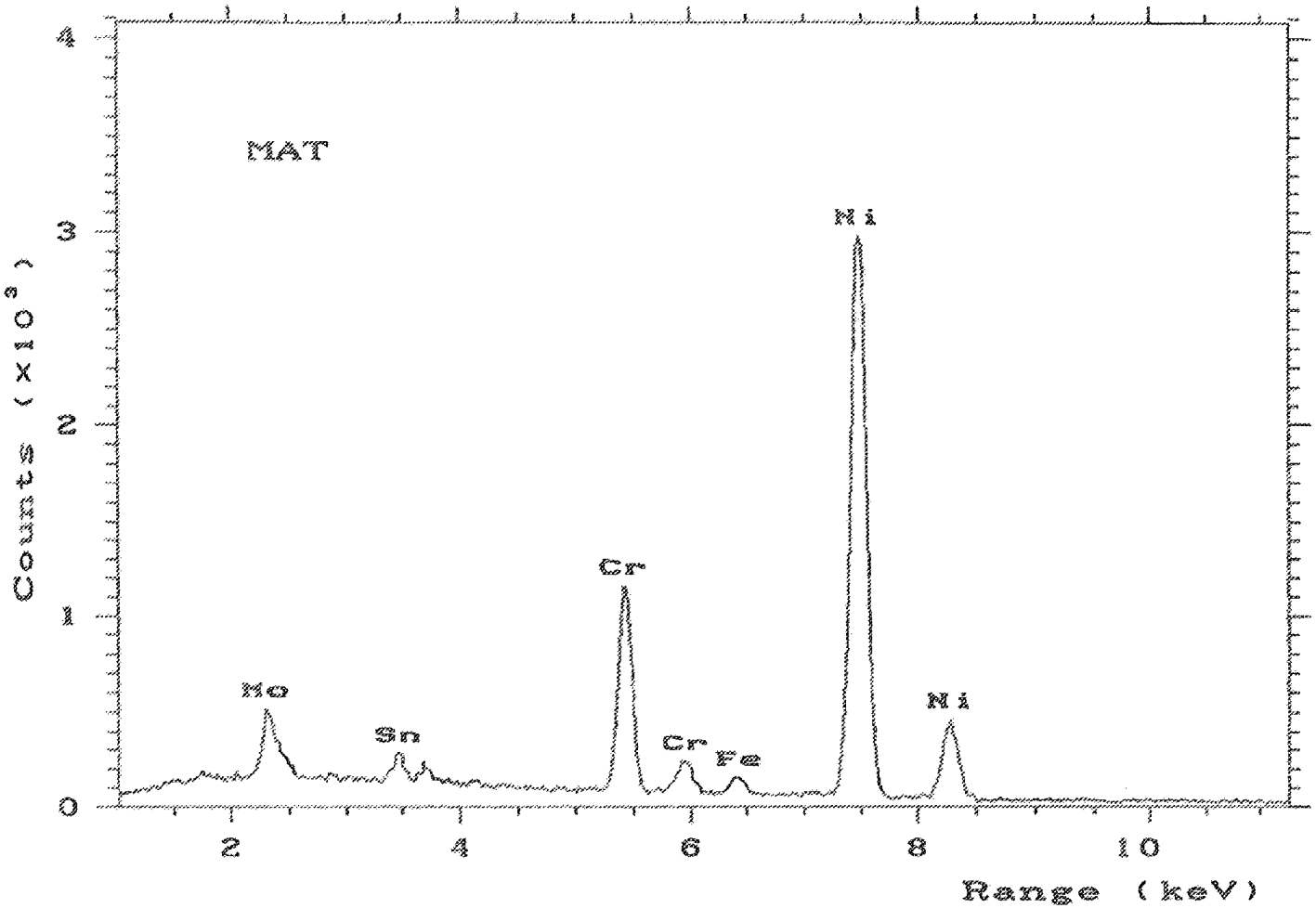
FIG. 2 shows the EPMA phase analysis result for the matrix of the Te-containing anti-galling alloy of the present invention.
Figure 3:
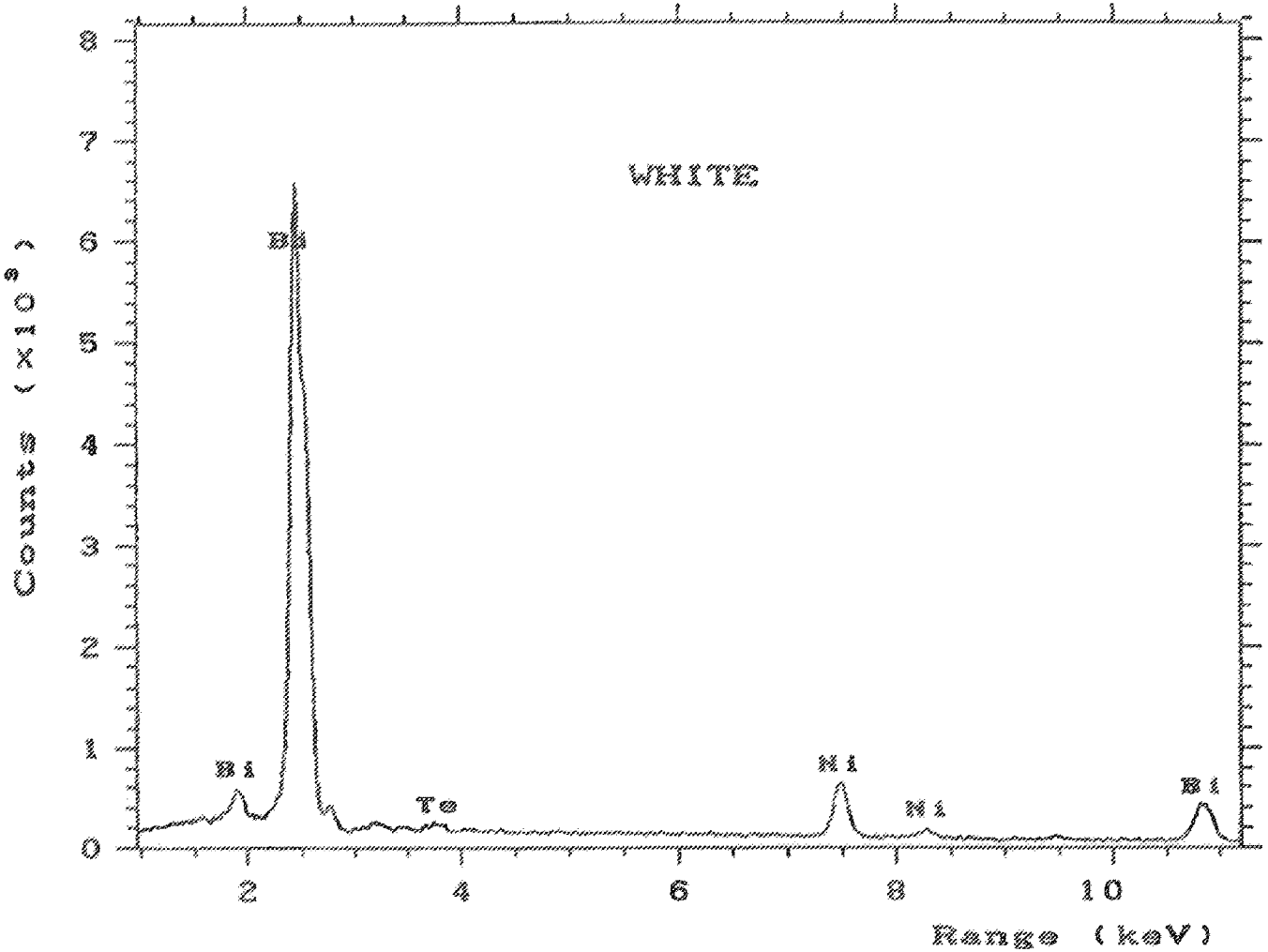
FIG. 3 shows the EPMA phase analysis result of the white precipitates.
Figure 4:
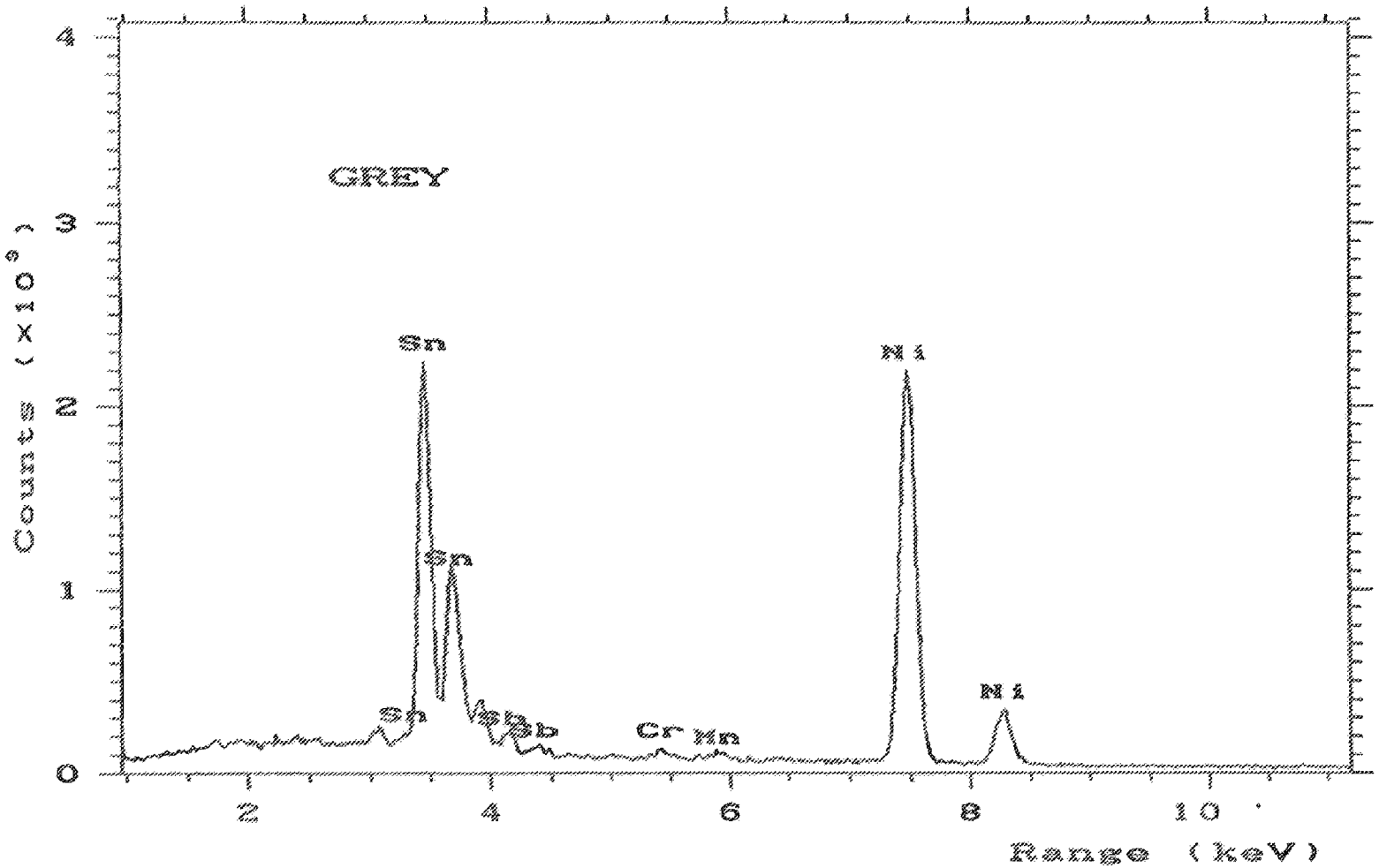
FIG. 4 shows the EPMA phase analysis result of the gray precipitates.

FIG. 2 shows the EPMA phase analysis result of the matrix of the Te-containing anti-galling alloy of the present invention. FIG. 3 shows the EPMA phase analysis result of the white precipitates. FIG. 4 shows the EPMA phase analysis result of the gray precipitates. FIG. 2 shows each peak of Ni, Cr, Sn and Mo, which are constituents of the alloy. FIG. 3 and FIG. 4 show Bi and Sn peaks, which show that both Bi and Sn form precipitate and they contribute to the anti-galling effect.

Figure 5:
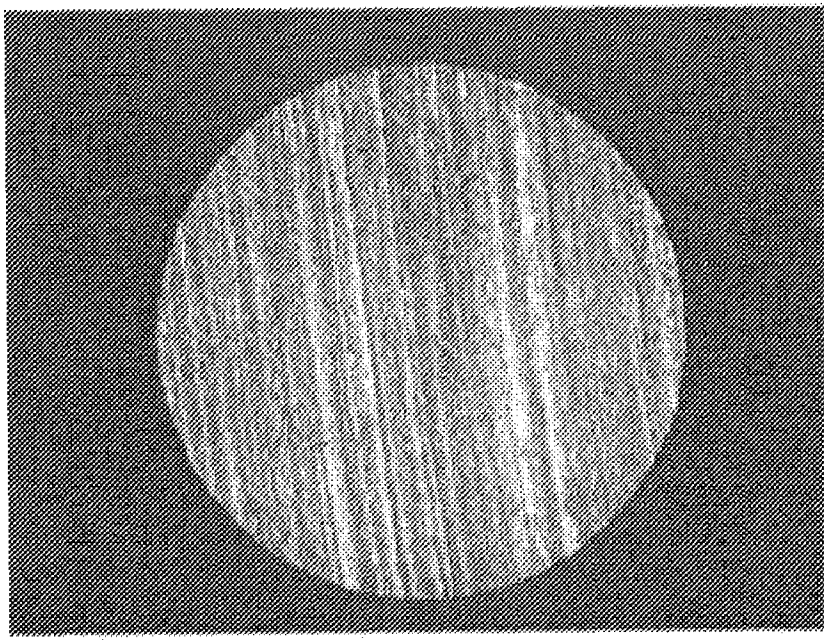
FIG. 5 shows optical microscopic photographs of the Te-containing anti-galling alloy of the present invention (A) and the conventional anti-galling alloy (B), comparing the status of alloy surface, after having contacted with stainless steel and rotated for a given time.
Figure 5:
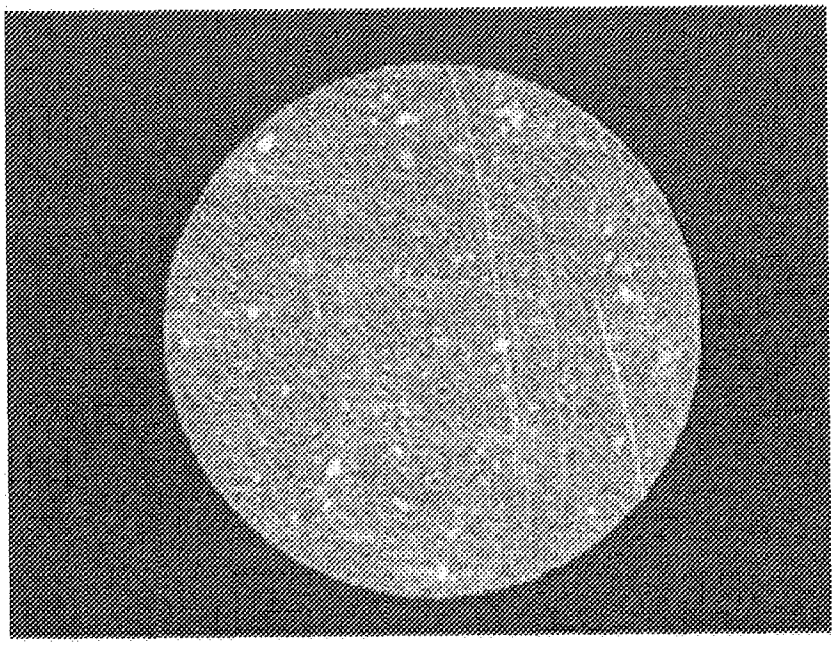

FIG. 5 shows optical microscopies of the Te-containing anti-galling alloy of the present invention (A) and the conventional anti-galling alloy (B), comparing the alloy surface status, after the galling test. While the alloy of the present invention has relatively smooth abrasion surface, the conventional Bi anti-galling alloy reveals relatively distinct scratches, thus showing that it was more susceptible to galling stress.

The anti-galling alloy of the present invention has smooth abrasion surface because the uniform distribution of fine Bi precipitates between the dendrite arms, as seen in FIG. 1, and covers the alloy surface during abrasion thereby offering anti-galling effect.

The anti-galling alloy of the present invention is prepared as follows. Ni, Cr and Mo with high melting points are melt first and easily evaporating Sn, Bi and Te are fed later after a melt has been formed to reduce evaporation loss. Particularly, it is recommended to add Bi in the form of Sn—Bi mother alloy or Te—Bi mother alloy because direct addition of Bi generates yellow smoke. Either an electric resistance furnace or a high frequency furnace can be used as smelting furnace. Considering the uniformity of the alloy composition, it is recommended to use a high frequency furnace equipped with a stirrer. Also, use of a deoxidizer and a degassing agent are required in case of melting in air. The alloy of the present invention can be used as prepared without additional heat treatment.

Hereinafter, the present invention will be described in more detail through Examples. However, the following Example is only for the understanding of the present invention, and the scope of the present invention is not limited by the following Example.

EXAMPLES 100 kg of metals having the composition of Table 1 was melt in a high frequency induction smelting furnace of 1,550° C. under Ar atmosphere and cast to obtain an alloy sample.

TABLE 1

Composition of anti-galling alloy sample (wt %)

| | Metal elements | | | | | | | |
|---|---|---|---|---|---|---|---|---|
| | Ni | Cr | Sn | Mo | Bi | Te | Fe | Si |
| Alloy of the present invention | 72.4 | 12.5 | 4.5 | 3.0 | 5.0 | 1.2 | 1.2 | 0.2 |
| Alloy of control group | 73.6 | 12.5 | 4.5 | 3.0 | 5.0 | 0 | 1.2 | 0.2 |

FIG. 1 shows optical microscopies of the alloy of the present invention and the conventional anti-galling alloy, comparing the microstructure and precipitate dispersion status, and FIGS. 2 to 4 show the EPMA phase analysis results.

TEST EXAMPLE

Physiochemical properties including abrasion rate, corrosion resistance and hardness were measured as follows for the alloy of the present invention and the alloy of the control group.

1. Surface Status after Galling Test

Abrasion test was performed according to ASTM G-99 in order to observe the surface abrasion status of contacting and moving sample. An alloy sample processed to a pin having a diameter of 2 mm was rubbed against a metal disk (Stainless Steel 316) rotating at 100 rpm for 60 minutes with a load of 20 kg. Then, the abrasion surface of the sample was observed.

As seen in FIG. 5, the alloy of the control group experienced galling on the surface. However, the alloy of the present invention had a very smooth surface, which confirms its superior anti-galling properties.

2. Evaluation of Abrasion Rate

Abrasion rate was determined based on weight loss of each alloy after the abrasion test. The result is shown in Table 2 below. The abrasion rate of the alloy of the present invention was lower than-that of the control group.

TABLE 2

Evaluation of abrasion rate

| Classification | Alloy of present invention | Alloy of control group |
|---|---|---|
| Before test | 91.33 g | 91.50 g |
| After test | 91.27 g | 91.25 g |
| Abrasion rate | 0.06 g/hr | 0.25 g/hr |

3. Corrosion Test

For the alloy of the present invention to be used in chemical machines and food processing machines as well as industrial machineries, it should be resistant to acids. To test acid resistance, each alloy sample was immersed in strong sulfuric acid, hydrochloric acid and nitric acid solutions maintained at 50° C. for 360 hours, and the corrosion rate was determined. The result is shown in Table 3 below. The alloy of the present invention and that of the control group showed comparable corrosion rate in sulfuric acid solution. However, in hydrochloric acid and nitric acid solutions, the corrosion rate of the alloy of the present invention was significantly lower than that of the control group thus showing its superior acid resistance.

TABLE 3

Evaluation of abrasion rate

| Classification | Alloy of present invention | Alloy of control group |
|---|---|---|
| 98% $H_2SO_4$ | 1.6790 g/year | 1.5038 g/year |
| 36% HCl | 7.1053 g/year | 13.4076 g/year |
| 60% $HNO_3$ | 4.5844 g/year | 6.5408 g/year |

4. Hardness Test

Since the alloy of the present invention needs to be used in structural wet machinery parts such as rotor and shaft, it should have a hardness of a certain degree. The Vickers hardness was measured according to the standard method. As seen in Table 4 below, the alloy of the present invention has comparable or superior hardness to that of the control group. This seems to be due to the pinning effects resulted from fine structures as well as uniform distribution of fine precipitates.

TABLE 4

Hardness measurement

| Classification | Alloy of present invention | Alloy of control group |
|---|---|---|
| Vickers hardness | 149 | 138 |

As described above, the present invention relates to an anti-galling alloy having a novel composition wherein Te is added to the conventional Ni—Cr based alloy. Addition of Te gives fine dendritic structure instead of the grain structure of the conventional alloy. Also, while anti-galling Bi precipitates are ununiformly distributed on the grain boundary in the conventional alloy the Te-containing fine Bi-rich precipitates are uniformly distributed between the dendritic structures in the present invention. Because the precipitates uniformly cover the alloy surface during abrasion, the alloy avoids galling or surface scratching. Also, since it reduces friction coefficient, the abrasion rate is reduced and the life cycle of material is extended. In addition, the alloy of the present invention has satisfactory physicochemical properties such as corrosion resistance and hardness, as shown in Test Example.

Accordingly, the anti-galling alloy of the present invention can be used in wet machinery parts such as rotor, shaft and valve, replacing the conventional alloys, and significantly contribute to life cycle extension and mechanical precision improvement.

While the present invention has been described with reference to the preferred embodiments, those skilled in the art will appreciate that various modifications and substitutions can be made thereto without departing from the spirit and scope of the present invention as set forth in the appended claims.

What is claimed is:

1. An anti-galling alloy comprising 70 to 75 wt % of Ni, 8 to 14 wt % of Cr, 3 to 7 wt % of Bi, 3 to 6 wt % of Sn, 1 to 4 wt % of Mo, less than 2 wt % of (Fe+Si) and 1 to 3 wt % of Te, capable of being used as prepared without heat treatment.

2. The anti-galling alloy of claim 1 wherein the matrix of said anti-galling alloy has a fine dendritic structure and thereby fine Bi-rich precipitates are uniformly dispersed between the spacing of said dendritic structure.

3. The anti-galling alloy of claim 2, wherein said anti-galling alloy has a dendritic structure and has good anti-galling properties, corrosion resistance and hardness due to said fine Bi-rich precipitate distribution.

4. The anti-galling alloy of claim 3, wherein said Bi-rich precipitates cover the alloy surface to reduce the friction coefficient and abrasion rate and prevent cracking due to stress at the abrasion surface.

5. The anti-galling alloy of claim 1, wherein said anti-galling alloy is used as parts for wet machinery.

* * * * *